United States Patent [19]

James

[11] Patent Number: 4,680,819

[45] Date of Patent: Jul. 21, 1987

[54] INVALID HOISTS

[75] Inventor: David R. James, Glenyard, England

[73] Assignee: James Industries Limited, Gloucester, England

[21] Appl. No.: 848,647

[22] Filed: Apr. 7, 1986

[30] Foreign Application Priority Data

May 1, 1985 [GB] United Kingdom ..... 8511083

[51] Int. Cl.[4] ..... A61G 7/10

[52] U.S. Cl. ..... 5/86; 5/83

[58] Field of Search ..... 5/86, 83, 81 B, 81 R

[56] References Cited

U.S. PATENT DOCUMENTS

| | | | |
|---|---|---|---|
| 2,903,238 | 9/1959 | Flandrick | 5/86 |
| 2,962,730 | 12/1960 | Carnes et al. | 5/86 |
| 3,203,009 | 8/1965 | Lundberg | 5/86 |
| 3,252,704 | 5/1966 | Wilson | 5/83 |
| 3,694,829 | 10/1972 | Bakker | 5/86 |
| 3,962,737 | 6/1976 | James | 5/86 |
| 4,545,085 | 10/1985 | Feldt | 5/86 |

*Primary Examiner*—Alexander Grosz

*Attorney, Agent, or Firm*—Collard, Roe & Galgano

[57] ABSTRACT

A mobile invalid hoist comprises a lifting arm projecting from an upstanding support column mounted on a mobile chassis. The chassis comprises a main portion which supports the column, and two chassis side members which are pivotally mounted on the main chassis portion. Two coaxial fixed-axis wheels support the main chassis portion and the chassis side members, which project forwardly from the main chassis portion, have front support castors.

10 Claims, 4 Drawing Figures

INVALID HOISTS

BACKGROUND OF THE INVENTION

1. Field of the Invention

The invention relates to invalid hoists of the type comprising a lifting arm projecting from an upstanding support structure or column mounted on a mobile chassis.

2. Description of the Prior Art

Hoists of the foregoing type commonly have a chassis which is open at the front between side members of the chassis with the support structure or column mounted adjacent the rear of the chassis which is supported on front and rear castors. With such an arrangement it is known for the chassis to be of adjustable width, with the side members laterally movable or pivoted adjacent the rear, to provide a minimum width for use in confined spaces and passing through doorways whereas the width of at least the front opening can be increased to fit around a wheelchair, for example.

A hoist supported on four castors provides the required manoeuvrability but suffers from lack of straight-line or directional stability, particularly when being wheeled over a deep pile carpet. To provide directional stability whilst still providing sufficient manoeuvrability it has been proposed that the chassis should be supported on two rear fixed-axis wheels and two front castors. Whilst this arrangement is satisfactory for a fixed width chassis it precludes use of prior forms of adjustable chassis.

SUMMARY OF THE INVENTION

The object of the invention is to provide a hoist with the advantage of an adjustable width chassis whilst retaining the directional stability provided by rear fixed-axis support wheels.

According to the invention a mobile invalid hoist has a chassis comprising a main portion supporting the upstanding support structure or column and on which are mounted two coaxial fixed-axis support wheels and two chassis side members which are pivotally mounted on the main chassis portion, project forwardly therefrom and are supported by front support castors. Thus the rear wheels provide directional stability and front castors provide manoeuvrability whilst allowing pivotal width adjustment of the chassis side members.

The fixed-axis wheels are desirably mounted as far forward as possible to improve directional stability and manoeuvrability and to facilitate pivotal adjustment of the side members when the hoist is in use. Operational requirements tend to limit how far forward the fixed-axis wheels can be mounted, and it will be appreciated that they must be disposed rearwardly of the centre of gravity of the hoist when in use. The main chassis portion preferably has at least one and desirably two rear stabiliser castors which are normally clear of the ground and which prevent the hoist tipping backwards about the forward-mounted fixed-axis wheels, particularly when the hoist is not carrying a patient, and these stabiliser castors enable the fixed-axis wheels to be mounted forwardly of the centre of gravity of the hoist when unloaded.

Preferably the main chassis portion is of inverted U-shape with a top limb, on which the support structure or column is mounted, and two side limbs which provide the pivots for the chassis side members. The side members may be independently adjustable by separate lever-operated eccentric pin or cam actuators which are preferably designed to go over centre, thus providing two over-centre positions one of which positively defines the minimum chassis width with the side members parallel and the other of which positively defines the maximum width position with the side members splayed apart.

Other features of the invention will be apparent from the following description, drawing and claims, the scope of the invention not being limited to the drawings themselves as the drawings are only for the purpose of illustrating ways in which principles of the invention can be applied. Other embodiments of the invention utilizing the same or equivalent principles may be made as desired by those skilled in the art without departing from the present invention and the purview of the appended claims.

DESCRIPTION OF THE PREFERRED EMBODIMENT

Figure 1:
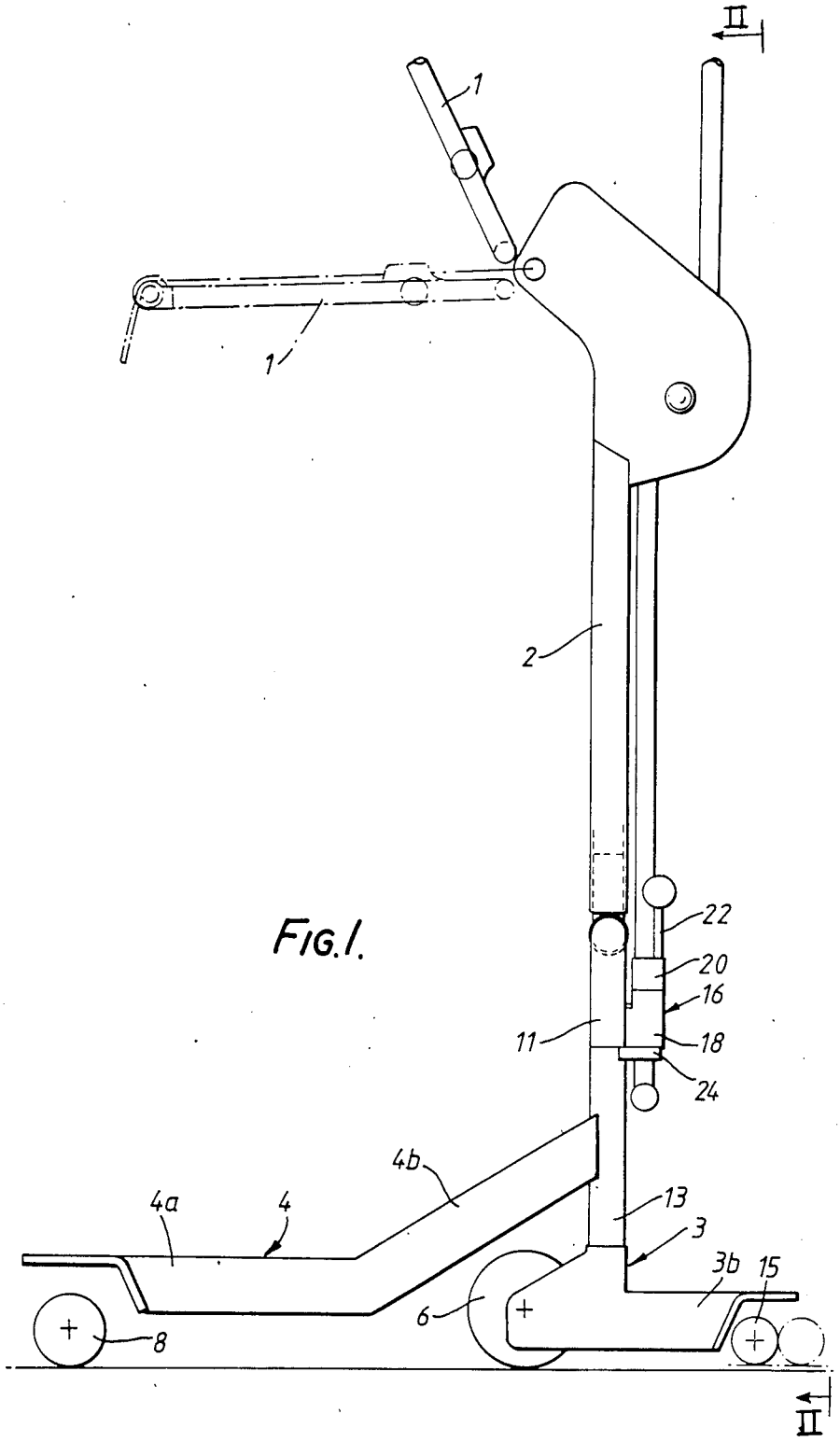
FIG. 1 is a side view of a hoist in accordance with the invention.

The hoist comprises a lifting arm 1 projecting from a support structure in the form of a column 2 mounted on a mobile chassis which comprises a main portion 3 and two side members 4 and 5. The chassis is supported on two coaxial fixed-axis wheels 6 and 7 and two front castors such as 8 respectively mounted at the front ends of the side members 4 and 5. The main chassis portion 3 is of inverted generally U-shape and comprises an upper tubular steel component 3*a* and lower base components 3*b*. The component 3*a* has a top limb 9 to which is fixed an upstanding rectangular-section spigot 10 on which the column 2, which is of corresponding rectangular section, is detachably mounted. Vertical side limbs 11 and 12 of the component 3*a* provide pivots on which bosses 13 and 14 of the side members 4 and 5 are pivotally mounted.

Figure 2:
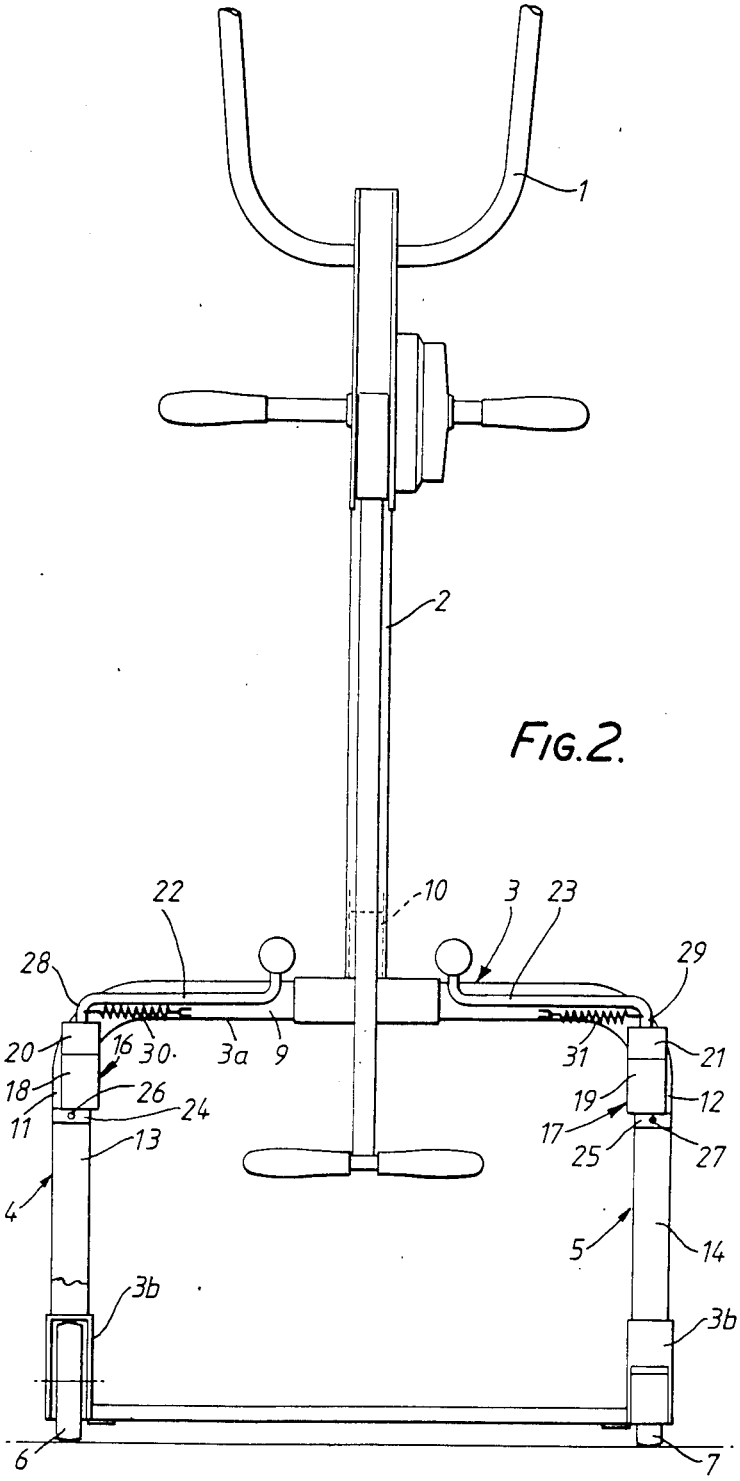
FIG. 2 is a rear view thereof partly in reverse section on the line II—II in FIG. 1.

The wheels 6 and 7 are of comparatively large diameter to provide good straight-line direction stability and they are disposed forwardly of the column 2 a small distance in front of the centre of gravity of the unloaded hoist. The main chassis portion 3 has rear side castors such as 15 mounted below the base components 3*b* and which are normally clear of the ground (as shown in FIG. 1) when the hoist is carrying a patient, and thus act as stabilisers to prevent the hoist inadvertently being tipped rearwardly in the loaded condition. The castors 15 are for clarity omitted from FIG. 2 and in the unloaded hoist condition the front castors 8 are not loaded and thus impose no resistance to pivotal width adjustment of the side members 4 and 5. Even when carrying a patient the castors 8 are still relatively lightly loaded due to the forward positioning of the wheels 6 and 7 a short distance behind the centre of gravity of the loaded hoist, and this assists both manoeuvrability and said pivotal width adjustment.

The foregoing arrangement also enables relatively small front castors 8 to be fitted and this allows the front portions such as 4*a* of the side members to be of low height, thus facilitating passage under a bed or bath tub for example. The front portions 4*a* are connected to the bosses 13 and 14 by rear sections such as 4*b* which are of appropriate length and downward inclination to clear the wheels 6 and 7.

Pivotal adjustment of the side members 4 and 5 is achieved by actuators 16 and 17, respectively. Each actuator 16 or 17 comprises a body 18 or 19 fixed to the corresponding side limb 11 or 12 and in which an operating member 20 or 21 is pivotally supported about a vertical axis. An operating lever 22 or 23 is fixed to the upper end of the corresponding member 20 or 21 which, at the lower end, has a projecting eccentric pin (not shown) which engages a slot in a plate 24 or 25 fixed to and projecting from the corresponding boss 13 or 14.

Figure 4:
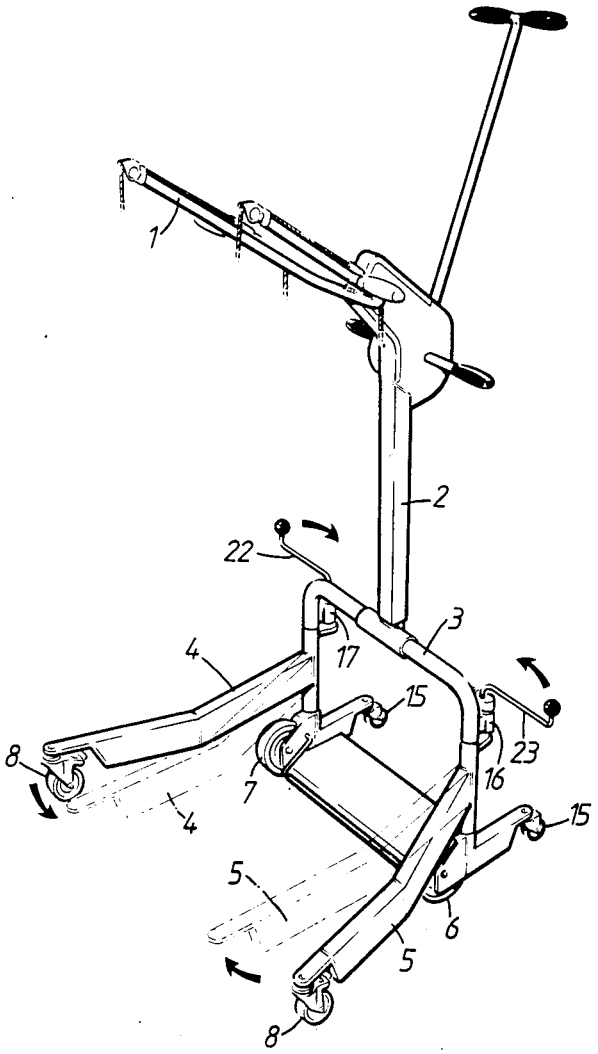
FIG. 4 is a perspective view of the hoist in accordance with the present invention.

The actuators 16 and 17 thus independently adjust the side members 4 or 5. In the minimum width position illustrated in FIG. 2 the side members 4 and 5 are parallel and the levers 22 and 23 project inwardly directly alongside the upper limb 9 as shown. Movement of either lever 22 or 23 through 180° to a position in which it is outwardly and laterally directed, as illustrated in FIG. 4 operates the corresponding actuator to move the related side member 4 or 5 to the maximum width position shown in solid lines in FIG. 4 in which the members 4 and 5 are splayed apart. In FIG. 4, the parallel minimum width position of side members 4 and 5 is shown diagrammatically in phantom. Each of the two described positions of the levers 22 and 23 represents an overcentre position of the non-illustrated eccentric pin in which the latter engages a stop screw 26 or 27, thereby providing positive location of the side members 4 and 5 in either one of their two alternative adjusted positions.

Figure 3:
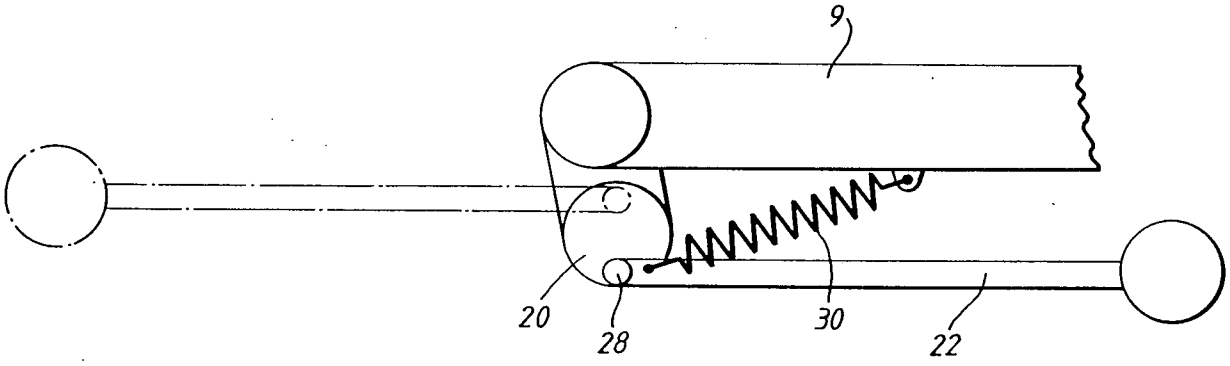
FIG. 3 is a diagrammatic top view of a part of the hoist of FIG. 1 showing a lever for operating a side member.

Each lever 22 or 23 has a stem 28 or 29 which is eccentrically fixed to the corresponding operating member 20 or 21, as can be seen from FIG. 3. A tension spring 30 or 31 acting as a "grasshopper" spring is connected between each stem 28 or 29 and the upper limb 9, and the spring tension retains the lever 22 or 23 in either position.

I claim:

1. A mobile invalid hoist comprising a chassis, a lifting arm, and an upstanding support structure mounted on said chassis and from which said lifting arm projects, said chassis comprising a main chassis portion supporting the support structure, two coaxial fixed-axis support wheels mounted on said main chassis portion, two chassis side members mounted on said main chassis portion so as to project forwardly therefrom, said chassis side members being pivotally adjustable relative to said main chassis portion about respective vertical pivotal axes, and two front support castors mounted on said chassis side members, whereby pivotal adjustment of said chassis side members varies the track of said front support castors and the width of a front opening of the chassis between said side members without varying the track of said fixed-axis support wheels.

2. An invalid hoist according to claim 1, wherein said fixed-axis wheels are mounted forwardly of said support structure.

3. An invalid hoist according to claim 1, wherein said chassis further comprises rear stabiliser castors mounted on said main chassis portion and which, in use of the hoist, are normally clear of the ground.

4. An invalid hoist according to claim 3, wherein said fixed-axis wheels are mounted forwardly of the center of gravity of the hoist when unloaded, in which unloaded condition the hoist is supported on said fixed-axis wheels and on said rear stabiliser castors.

5. An invalid hoist according to claim 1, wherein said main chassis portion is of inverted U-shape with a top limb, on which said support structure is mounted, and two vertical side limbs on which said chassis side members are respectively pivotally mounted.

6. An invalid hoist according to claim 5, wherein said support structure is a column mounted centrally on said top limb of said main chassis portion, and said arm is pivotally mounted on said column adjacent the upper end thereof.

7. An invalid hoist according to claim 5, wherein said side members are independently adjustable by separate lever-operated eccentric actuators.

8. An invalid hoist according to claim 1, wherein said chassis side members are mutually parallel in a minimum width condition of the chassis.

9. A mobile hospital hoist, comprising:

a mobile chassis, comprising a main portion supporting the support structure, two coaxial fixed-axis support wheels mounted on said main chassis portion, two chassis side members adjustably pivotally mounted on said main chassis portion so as to project forwardly therefrom, and two front support castors mounted on said chassis side members, said main chassis portion being of inverted U-shape with a top limb and two side limbs which respectively provide pivots for said chassis side members;

a lifting arm;

an upstanding support structure mounted on said top limb of said main chassis portion and from which said lifting arm projects; and separate lever-operated actuators for independently adjusting said chassis side members, said actuators each having two alternative over-centre positions one of which positively defines a minimum chassis width and the other of which positively defines a maximum chassis width with said chassis side members splayed apart, and spring means operative to retain said actuators in either one of said two overcentre positions thereof.

10. A mobile invalid hoist comprising a mobile chassis, a lifting arm, and an upstanding support structure mounted on said chassis and from which said lifting arm projects, said chassis comprising a main portion supporting the support structure, two coaxial fixed-axis support wheels mounted on said main chassis portion forwardly of said support structure, at least one stabilizer castor mounted on said main chassis portion rearwardly of said support structure so as to be clear of the ground in normal use of the hoist supporting and transporting an invalid, two chassis side members mounted on said main chassis portion so as to project forwardly therefrom, said chassis members being pivotally adjustable relative to said main chassis portion about respective vertical pivotal axes, and two front support castors mounted on said chassis side members, whereby pivotal adjustment of said chassis side members varies the track of said front support castors and the width of a front opening of the chassis between said side members without varying the track of said fixed-axis support wheels.

* * * * *